US011661822B2

(12) United States Patent
Rosas Fermin et al.

(10) Patent No.: US 11,661,822 B2
(45) Date of Patent: May 30, 2023

(54) TELESCOPING TRANSITION JOINT FOR THE PROTECTION OF CONTROL LINES AND OTHER TOOLS AND COMPONENTS

(71) Applicant: Halliburton Energy Services, Inc., Houston, TX (US)

(72) Inventors: Eulalio De Jesus Rosas Fermin, Spring, TX (US); Justin Mark Roberts, Edmonton (CA); David Joe Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/585,239

(22) Filed: Jan. 26, 2022

(65) Prior Publication Data

US 2022/0333462 A1 Oct. 20, 2022

Related U.S. Application Data

(60) Provisional application No. 63/176,038, filed on Apr. 16, 2021.

(51) Int. Cl.
*E21B 41/00* (2006.01)
*E21B 17/07* (2006.01)
*E21B 7/06* (2006.01)

(52) U.S. Cl.
CPC ..... *E21B 41/0035* (2013.01); *E21B 7/061* (2013.01); *E21B 17/07* (2013.01)

(58) Field of Classification Search
CPC ..... E21B 7/061; E21B 23/08; E21B 23/10; E21B 23/12; E21B 23/14; E21B 41/0035; E21B 41/0042
See application file for complete search history.

(56) References Cited

U.S. PATENT DOCUMENTS 5,394,951 A * 3/1995 Pringle ..... E21B 4/18 175/45
2005/0217858 A1* 10/2005 Galloway ..... E21B 7/061 166/358

(Continued)

FOREIGN PATENT DOCUMENTS

| | | |
|---|---|---|
| EP | 0859122 | 8/1998 |
| EP | 2354437 | 8/2011 |
| WO | 2013-103786 | 7/2013 |

OTHER PUBLICATIONS

International Search Report and Written Opinion for Application No. PCT/US2022/015192, dated May 11, 2022.

(Continued)

*Primary Examiner* — Robert E Fuller
*Assistant Examiner* — Lamia Quaim
(74) *Attorney, Agent, or Firm* — Scott Richardson; C. Tumey Law Group PLLC

(57) ABSTRACT

Systems and methods of the present disclosure relate to protecting a control line as it passes through a junction in a downhole environment. A retractable transition joint (RTJ) comprises at least two members. A first member is operable to retract into a second member. A tubular extends through the first and second members. The tubular comprises a distal end that is removably attached to a distal end of the second member. The first and second members are operable to receive the control line.

20 Claims, 7 Drawing Sheets

(56) References Cited

U.S. PATENT DOCUMENTS

| | | | | |
|---|---|---|---|---|
| 2016/0084047 | A1 | 3/2016 | Carmody et al. | |
| 2018/0274300 | A1 | 9/2018 | Vemuri et al. | |
| 2018/0340387 | A1* | 11/2018 | Eggers | E21B 47/12 |

OTHER PUBLICATIONS

RapidX TAML 5 High-Strength, Hydraulic-Sealed Multilateral Junction, Accessed Jan. 20, 2022.
RapidXtreme RapidX, Accessed Jan. 20, 2022.
RapidXtreme TAML 3, 4, or 5 Large-Bord Multilateral Junction RapidXtreme, Accessed Jan. 20, 2022.
RapidXtreme TAML 3, 4, or 5 large-bore multilateral junction is a robust, modular system. It is currently the only multilateral system in the industry that is rated at 10,000 psi differential pressure at the junction, Accessed Jan. 20, 2022.
Manara System in Multilateral Wells, Control flow from each zone in each lateral, separately, Schlumberger, Accessed Jan. 20, 2022.

* cited by examiner

TELESCOPING TRANSITION JOINT FOR THE PROTECTION OF CONTROL LINES AND OTHER TOOLS AND COMPONENTS

BACKGROUND

In order to provide communications, control, and monitoring in lateral wellbores, control lines may need to be positioned in the lateral wellbores. When running the control lines through a junction (e.g., a casing window), the control lines may be inclined to rub against the junction. For example, sides of the junction (e.g., a milled edge of the casing window) may cut or abrade the control lines. In addition, the need to pick up on a completion string with the control lines fastened may cause the control lines to rub against a top edge of the junction causing the control lines to be pinched, crushed, cut, or otherwise damaged.

BRIEF DESCRIPTION OF THE DRAWINGS

These drawings illustrate certain aspects of some examples of the present disclosure and should not be used to limit or define the disclosure.

DETAILED DESCRIPTION

The present disclosure generally relates to techniques for protecting a control line passing through a junction in a downhole environment. In some examples, the junction may include a milled casing exit/window, pre-milled casing exit, earthen junctions, and/or twigs.

In particular examples, a tubular guide may span the junction while the control line is being deployed from a primary wellbore out into a secondary wellbore (e.g., a lateral wellbore). The tubular guide may include a retractable transition joint (RTJ) that may be operable to retract (e.g., collapse) such that a component of the completion string, a running tool for the completion string, and/or a tool located above/up-hole to the completion string (e.g., a junction or lateral liner tool) may retract a portion of the RTJ into the secondary wellbore. This retraction of the RTJ into the secondary wellbore may allow full inner diameter (ID) access to the primary wellbore. The RTJ may include a first member movably disposed within a second member. In some examples, the first and second members may include tubulars. The first member may include an outer diameter (OD) that is less than an ID of the second member and may be operable to retract within the second member (e.g., telescopic members). In some examples, the first member may be concentrically disposed within the second member.

The RTJ may be sized to pass into the secondary wellbore without issue. In some examples, the first member (e.g., an up-hole portion of the RTJ) may include an end with a tapered profile (e.g., concave or a scoop-head) to gradually guide the control lines and/or related equipment into the RTJ without causing damage to the control lines and the related equipment.

In some examples, an extension lock may secure the first member within the second member, in an extended position, and prevent retraction of the first member into the second member. An extension lock release mechanism may unlock the first member from the second member to allow retraction of the first member into the second member. In some examples, the first member may be shifted from an extended position to a retracted position upon actuation of the extension lock release mechanism. In additional examples, a retraction lock may secure the first member within the second member, in a retracted position. A separate device may control locking aspects.

In particular examples, the RTJ may be run as a 1-piece assembly at the top of a lateral liner assembly; or the RTJ may be run as a 2-piece assembly. In other examples, the RTJ may include multiple pieces such as shear screws, collets, etc. The lower piece may be run on the lateral liner assembly and the upper piece may be run on the lower portion of a completion string.

Figure 1:
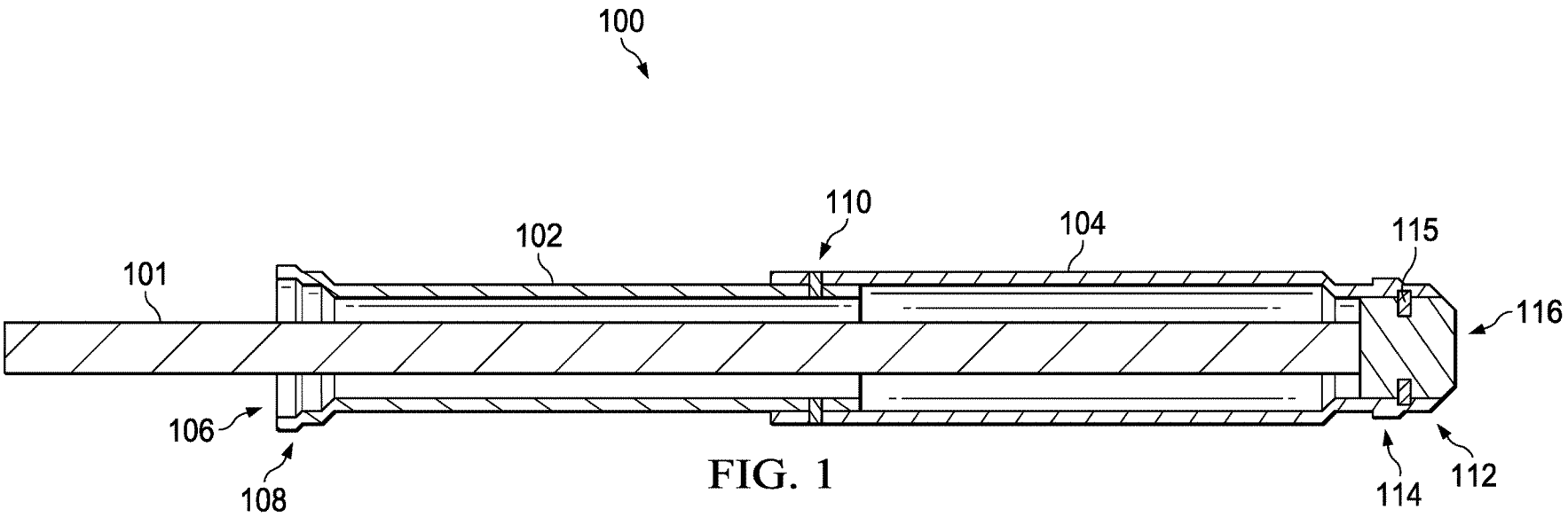
FIG. 1 illustrates a retractable transition joint (RTJ), in accordance with examples of the present disclosure.

FIG. 1 illustrates an RTJ 100 in accordance with examples of the present disclosure. The RTJ 100 may be disposed on a tubular 101 or a series of tubulars. The tubular 101 may be operable for use in a subterranean environment. The RTJ 100 may include a first member 102 movably disposed within a second member 104. In some examples, the first member 102 and the second member 104 may each include a tubular. The first member 102 may include an outer diameter (OD) that is less than an ID of the second member 104 and may be operable to retract within the second member 104 in an axial direction. In some examples, the first member 102 may be concentrically disposed within the second member 104. In some examples, the RTJ 100 may be sealed. In some examples, the RTJ 100 may have wiper seals to prevent debris from entering between the two members.

A proximal end 106 of the first member 102 may include a tapered profile 108. The tapered profile 108 may extend in an axial direction. In some examples, the tapered profile may be concave or include a scoop. The tapered profile 108 may include more than one material. For example, an aluminum bronze insert may line the guide to prevent a softer control line from wearing due to contact with a harder surface/material (e.g., 41XX steel typically used in making oilfield tubulars). The tapered profile 108 may be operable to gradually guide the control lines and related equipment into the RTJ without causing damage to the control lines and the related equipment. The proximal end 106 may also be utilized to retract (e.g., guide) the first member 102 into the second member 104 upon unlocking of an extension lock 110.

The extension lock 110 may secure the first member 102 within the second member 104, in an extended position, and prevent retraction of the first member 102 into the second member 104. In other examples, the extension lock 110 may releasably secure the first member 102 within the second member 104, but release the first member 102 from the second member 104 when a proper tool (or tool's profile) engages the extension lock 110. The extension lock 110 may allow the first member 102 into the second member 104 repeatedly locked in the extended and retracted positions. An extension lock release mechanism may unlock the first member 102 from the second member 104 to allow retraction of the first member 102 into the second member 104. In some examples, the proximal end 106 may be utilized to shift the first member 102 from an extended position to a retracted position, upon actuation of the extension lock release mechanism. In some examples, the first member 102 may be re-extended back up into the primary wellbore and the tubing string (with control lines) may be re-run back out into the secondary wellbore. In some examples, the first member 102 may be re-extended due to failure of equipment (e.g., inflow control equipment) during installation.

In some examples, a distal end 112 of the second member 104 may include a collet 114 for securing the second member 104 into a liner. The second member 104 may be removably coupled (e.g., locks 115) to a distal end 116 of the tubular 101. In some examples, the distal end 116 may include a convex portion (e.g., a bullnose).

Figure 2:
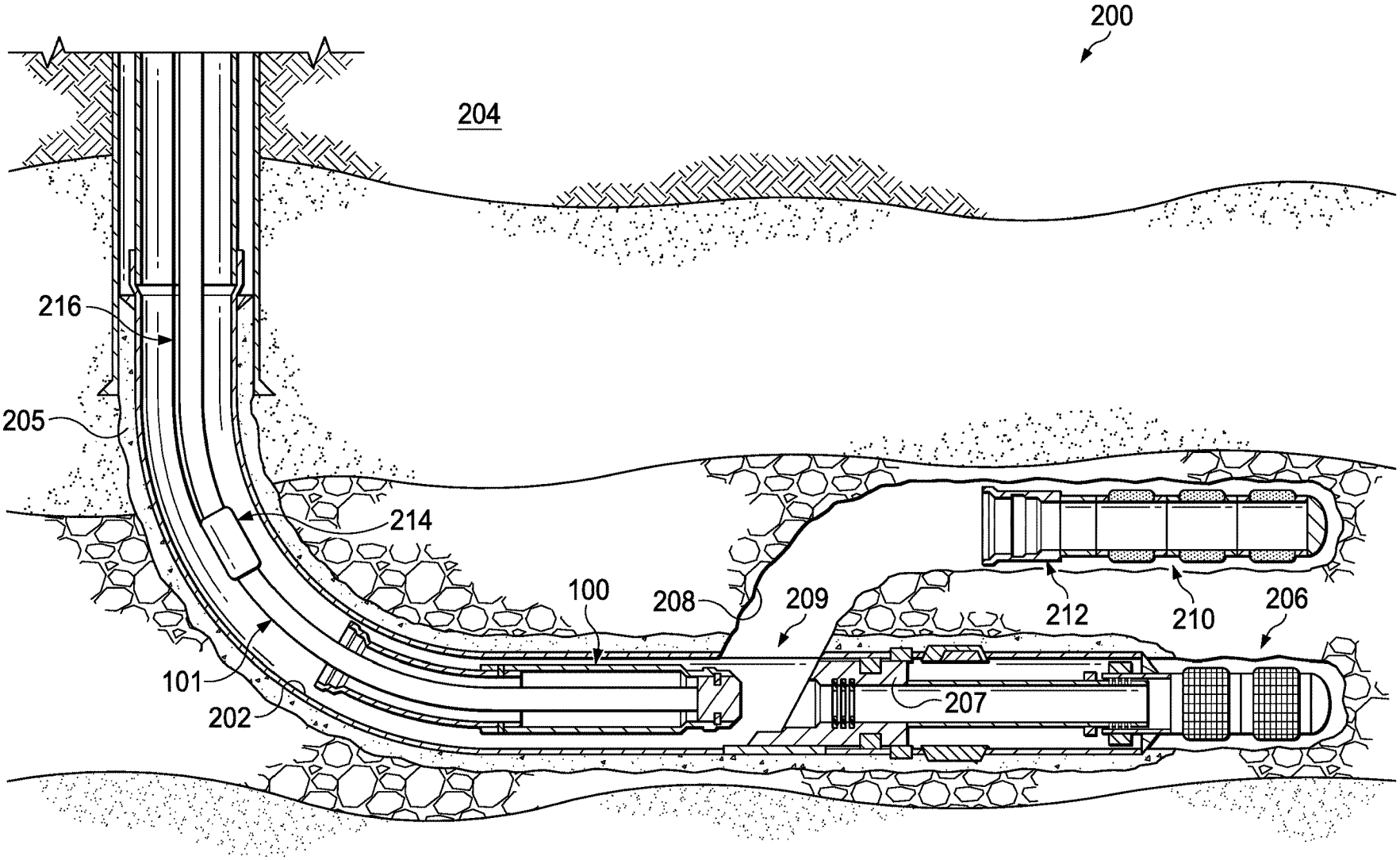
FIG. 2 illustrates deployment of the RTJ into a downhole environment including primary and secondary wellbores, in accordance with examples of the present disclosure.

FIG. 2 illustrates a well system 200 in accordance with examples of the present disclosure. A primary wellbore 202 extends through a subterranean formation 204. The wellbore 202 may include a substantially vertical section and a deviated section. The deviated section may be substantially horizontal. A portion of the primary wellbore 202 may be lined with a casing string 204, which may be secured in place with cement 205. The primary wellbore 202 may include a completion assembly 206 and a deflector 207 operable to deflect the RTJ 100 into a secondary wellbore 208.

The secondary wellbore 208 may extend from the primary wellbore 202 via a casing window 209. A liner 210 may be disposed within the secondary wellbore 206. The liner 210 may include a latch 212 (e.g., at an upper end) for attachment to the RTJ 100. The tubular 101 with the RTJ 100 may be run into the primary wellbore 202 and into the secondary wellbore 208 via the deflector 207. The tubular 101 may also include equipment 214 such as an inflow control valve, gauges, and/or other associated devices, coupled to a control line 216 extending along a portion of the tubular 101.

Figure 3:
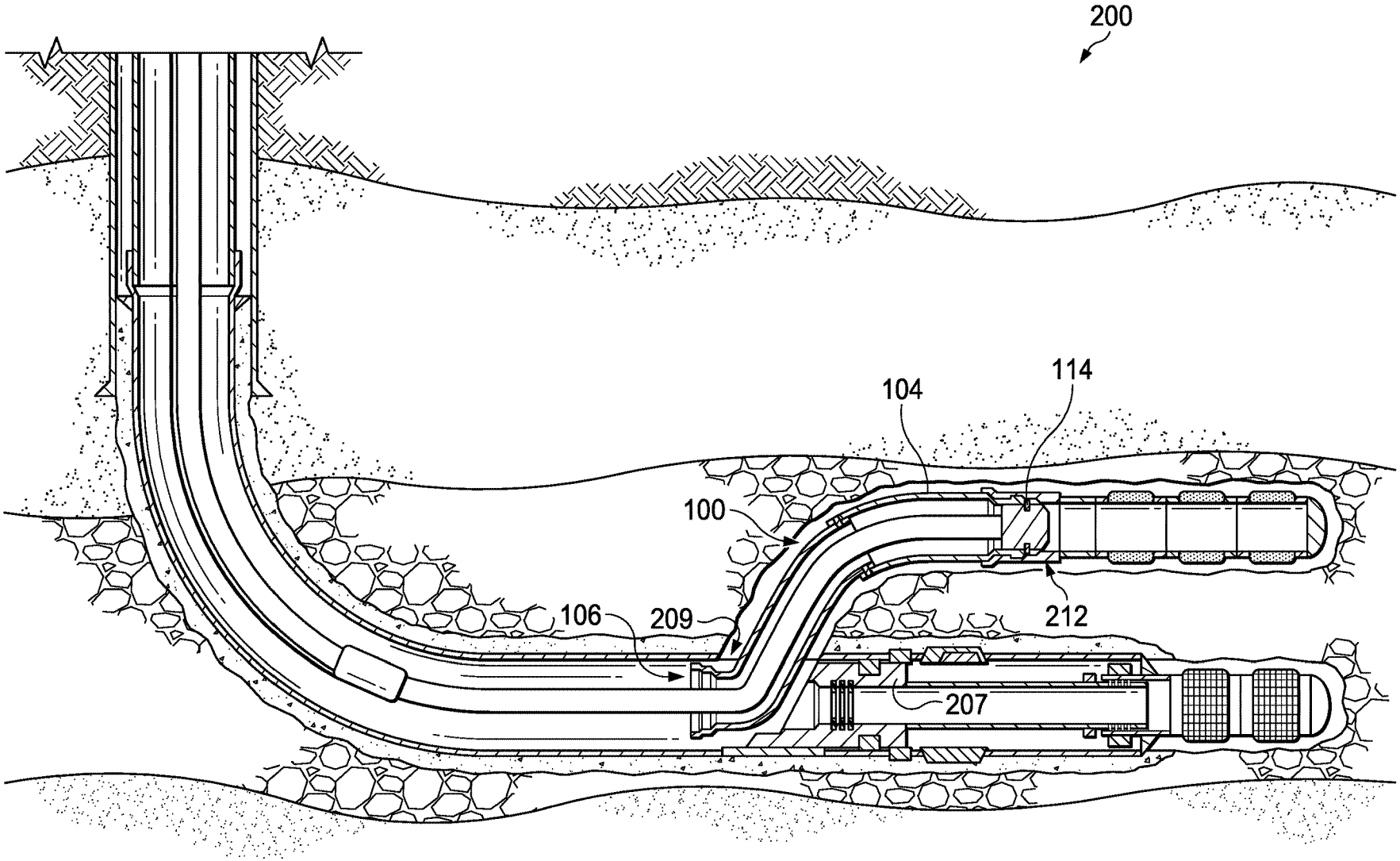
FIG. 3 illustrates moving the RTJ into the secondary wellbore, in accordance with examples of the present disclosure.

FIG. 3 illustrates the well system 200 with the RTJ 100 attached to the liner 210, in accordance with examples of the present disclosure. The RTJ 100 may be run into the secondary wellbore 208 via the deflector 207. The second member 104 of the RTJ 100 may be removably coupled to a top of the liner 210 via the latch 212 and the collet 114. The proximal end 106 of the RTJ 100 may be disposed up-hole from the window 209.

Figure 4:
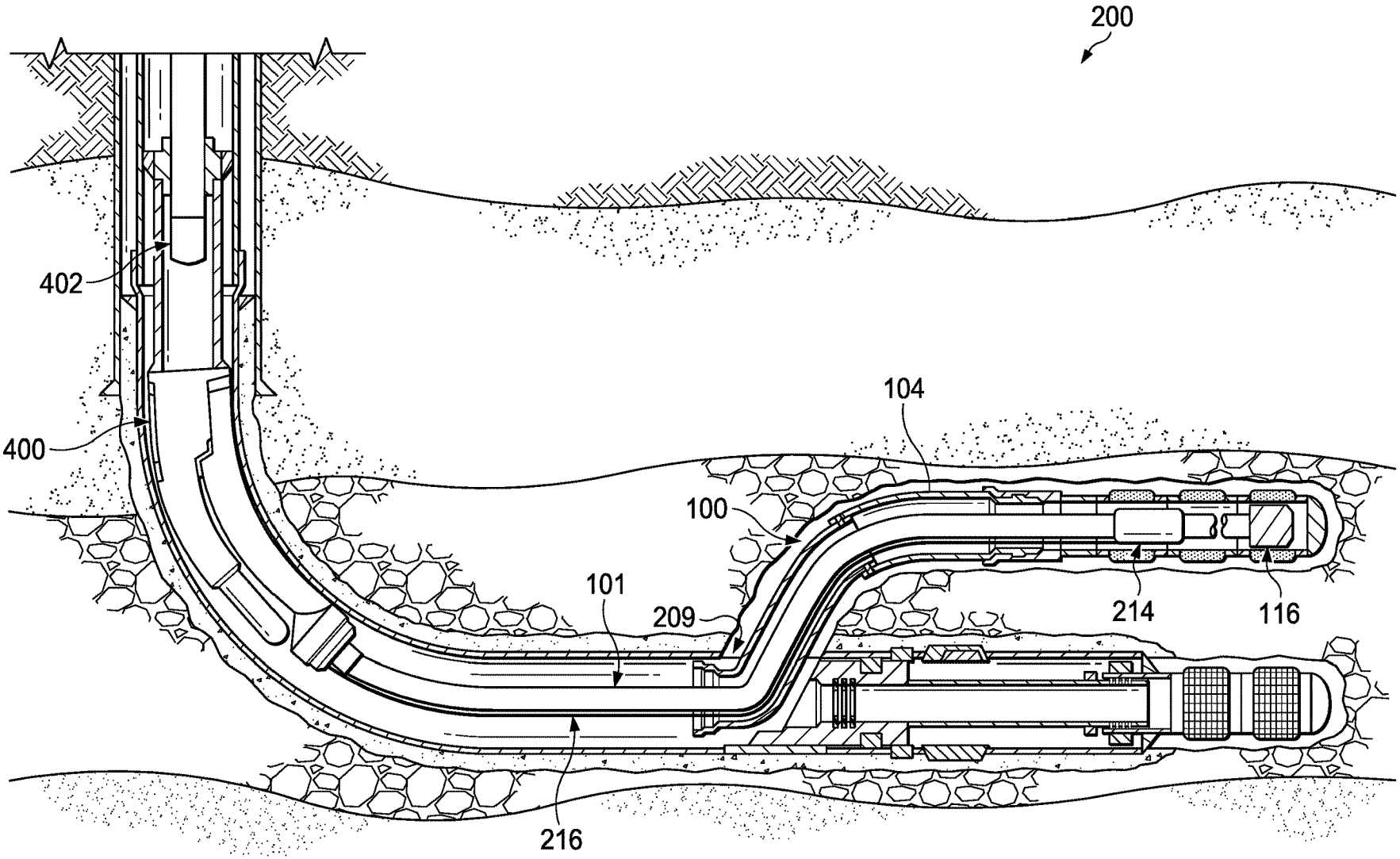
FIG. 4 illustrates moving a multilateral junction toward a window between the primary and secondary wellbores, in accordance with examples of the present disclosure.

FIG. 4 illustrates the well system 200 with the distal end 116 of the tubular 101 released from the second member 104 of the RTJ 100, in accordance with examples of the present disclosure. The tubular 101 may move forward to release the distal end 116 (e.g., bull nose) from the second member 104. The tubular 101 may also include a multilateral junction 400 (e.g., a shifting device) which may be attached to a downhole tool 402 (e.g., MWD tool or a liner hanger). The control line 216 may extend from the multilateral junction 400 through the first member 102 and the second member 104 of the RTJ 100 to the inflow control valve 214. The control line 216 is protected from the window 209, as shown.

In some examples, equipment that may be run on/with completion assembly 206, liner 210, tubing string, deflector 207, multilateral junction 400 and upper completion eventually located above 400 may include: Halliburton's Fuzion™-EH Electro-Hydraulic Downhole Wet-Mate Connector, Fuzion™-E Electric Downhole Wet-Mate Connector, Fuzion™-H Hydraulic Downhole Wet-Mate Connector, and/or Fuzion™-L Electro-Hydraulic/Electric Downhole Wet-Mate Connector, Fiber Optic Wet-Mate, a Inductive Coupler Wet-Mate, an Energy Transfer Mechanism (ETM), a Wireless Energy Transfer Mechanism (WETM), and/or an inductive coupler, sensors, recorders, actuators, choking mechanisms, flow restrictors, pressure-drop devices, and/or venturi tube containing devices. This equipment may be connected to a control line, a production and reservoir management system with in-situ measurements of pressure, temperature, flow rate, and water cut across the formation face in each zone of each lateral wellbore. Sensors may be packaged in one station with an electric flow control valve (FCV) that has infinitely variable settings controlled from the surface through one or more electrical, fiber optic, and/or hydraulic control lines. Multiple stations may be used to maximize hydrocarbon sweep and recovery with fewer wells, reducing capex, opex, and surface footprint.

Figure 5:
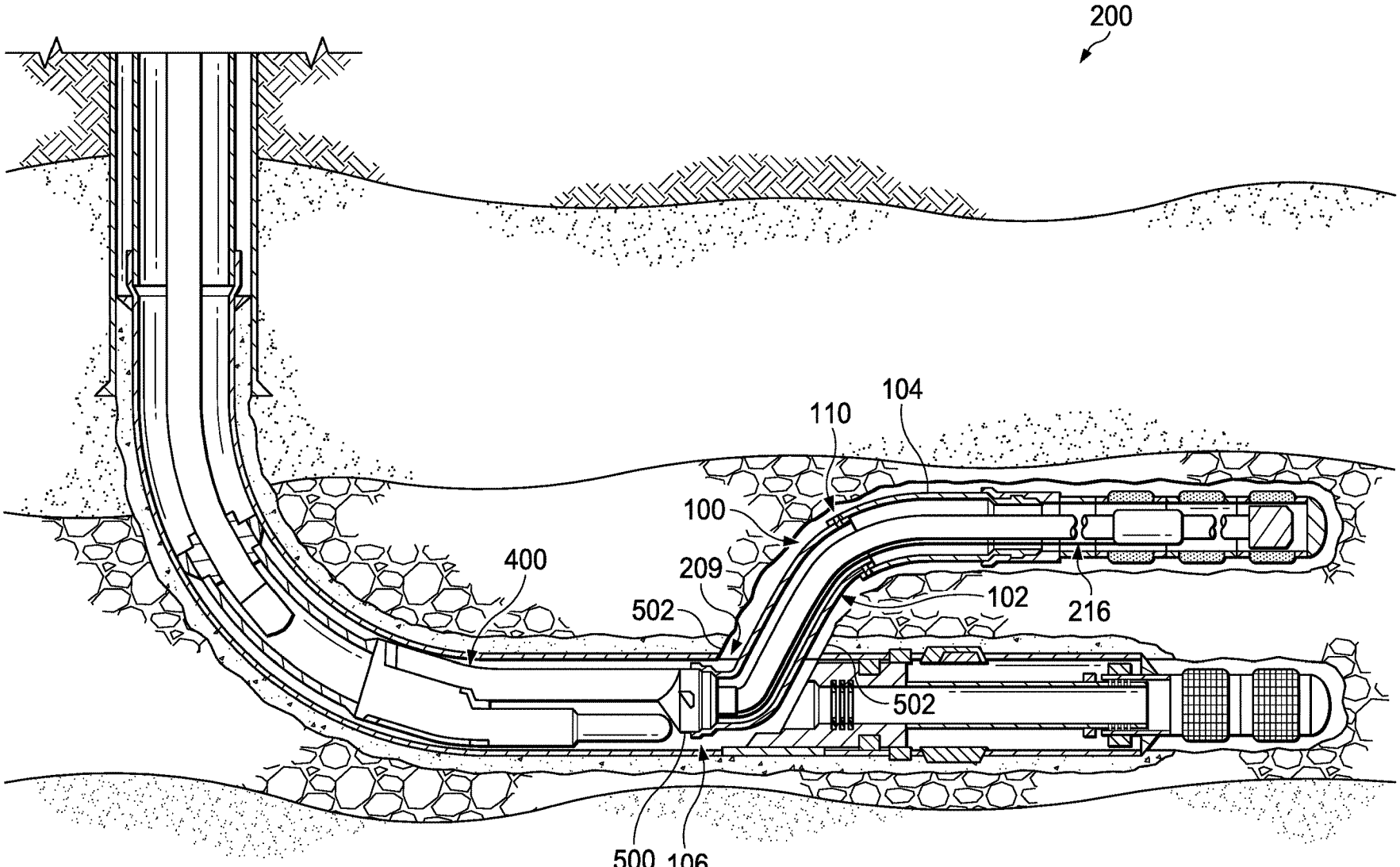
FIG. 5 illustrates contacting the RTJ with the multilateral junction, in accordance with examples of the present disclosure.

FIG. 5 illustrates the well system 200 with the multilateral junction 400 being attached to the proximal end 106 (e.g., concave or scoop head) of the RTJ 100, in accordance with examples of the present disclosure. The extension locks 110 may be unlocked to release the first member 102 from the second member 104 to allow the tubular 101 including the multilateral junction 400 and the downhole tool 402 to move forward against the proximal end 106 to retract the first member 102 into the second member 104, while the control line 216 is disposed within the RTJ 100 and thereby prevented from contacting boundaries 502 defining the window 209. The profile of the proximal end 106 may correspond to a shape of a distal end 500 of a portion 502 of the multilateral junction 400 to allow guided retraction of the first member 102 into the second member 104. For example, a convex shape of the distal end 500 may correspond (e.g., complement) to a concave shape of the proximal end 106 to allow a precise fit.

Figure 6:
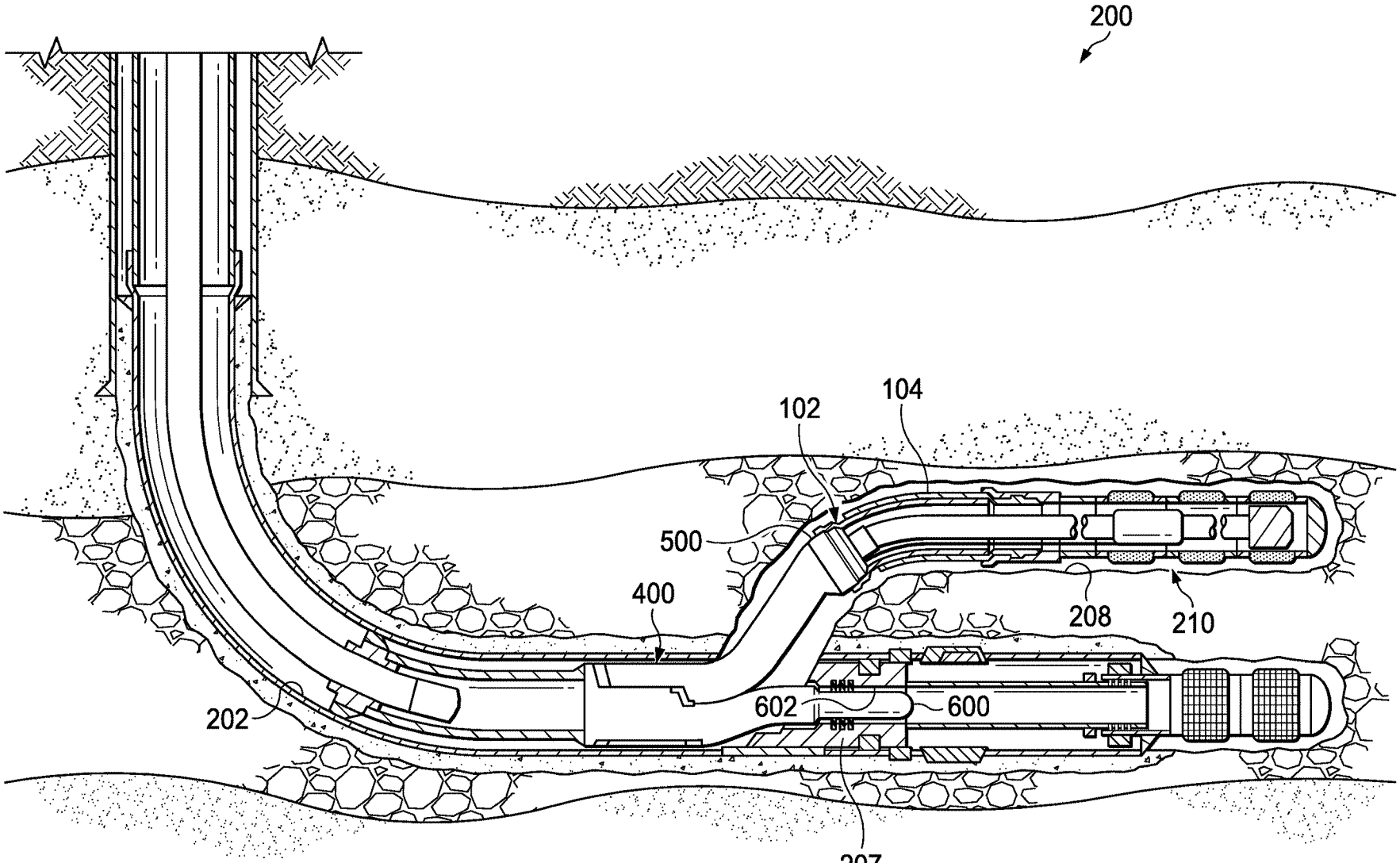
FIG. 6 illustrates retracting the RTJ within the secondary wellbore to allow full internal diameter (ID) access to the primary wellbore, in accordance with examples of the present disclosure.

FIG. 6 illustrates the well system 200 with the first member 102 retracted into the second member 104 in the secondary wellbore 208, in accordance with examples of the present disclosure. The multilateral junction 400 has landed such that the portion 500 passes through the window 209 into the proximal end 106 of the first member 102 of the RTJ 100 that is disposed and secured to the liner 210 in the secondary wellbore 208. A second portion 600 of the multilateral junction 400 is disposed within a bore 602 of the deflector 207 in the primary wellbore 202. This retraction of the RTJ 100 in the secondary wellbore may allow full ID access to the primary wellbore 202.

Figure 7:
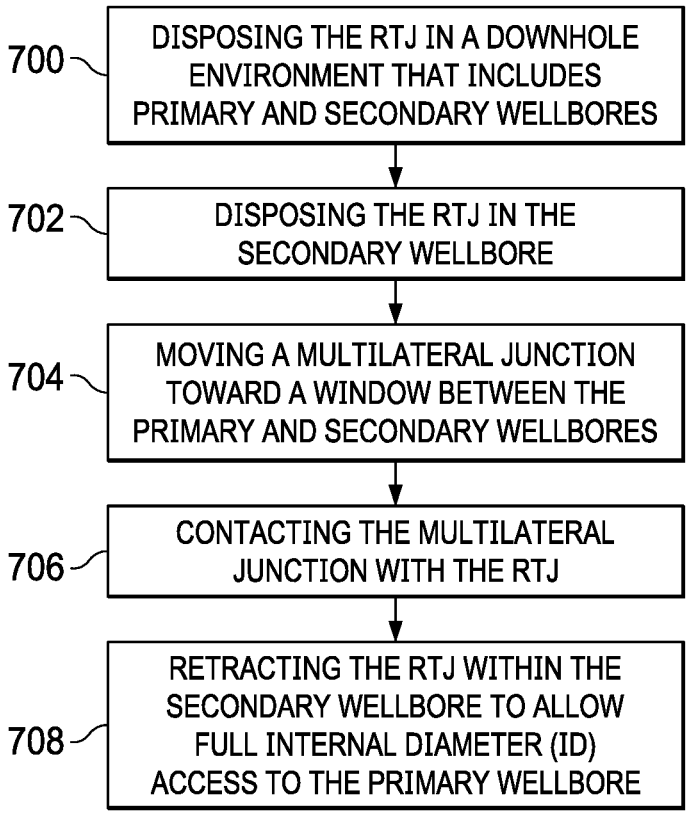
FIG. 7 illustrates an operative flow chart for the RTJ, in accordance with examples of the present disclosure.

FIG. 7 illustrates an operative flow chart for the RTJ 100, in accordance with examples of the present disclosure. At step 700, the RTJ 100 may be disposed in a downhole environment including primary and secondary wellbores (e.g., see FIG. 2). At step 702, the RTJ 100 may be disposed in the secondary wellbore (e.g., see FIG. 3). At step 704, a multilateral junction 400 may move toward a window between the primary and secondary wellbores (e.g., see FIG. 4). At step 706, the RTJ may contact the multilateral junction (e.g., see FIG. 5). At step 708, the RTJ 100 may retract within the secondary wellbore to allow full internal diameter (ID) access to the primary wellbore (e.g., see FIG. 6).

Accordingly, the systems and methods of the present disclosure may allow for safe passage of control lines through junctions that may be encountered in a downhole environment. The systems and methods may include any of the various features disclosed herein, including one or more of the following statements.

Statement 1. A retractable transition joint (RTJ) for passing a control line from a primary wellbore to a secondary wellbore, the RTJ comprises at least two members; wherein a first member is operable to retract into a second member; and a tubular extending through the first and second members, the tubular comprising a distal end removably attached to a distal end of the second member, wherein the first and second members are operable to receive the control line.

Statement 2. The RTJ of the statement 1, wherein the first member comprises a proximal end opposite to the distal end of the second member, the proximal end operable to receive a portion of a multilateral junction.

Statement 3. The RTJ of the statement 2, wherein a portion of the first member is disposed and locked to the second member.

Statement 4. The RTJ of any of the preceding statements, wherein the first member is movably disposed within the second member.

Statement 5. The RTJ of any of the preceding statements, wherein the distal end of the tubular is removably attached to the second member.

Statement 6. The RTJ of any of the preceding statements, wherein a portion of the distal end projects outward from the second member.

Statement 7. The RTJ of any of the preceding statements, wherein the distal end comprises a bull nose.

Statement 8. The RTJ of any of the preceding statements, wherein a distal end of the second member comprises a collet operable to latch to a liner.

Statement 9. A system for passing a control line from a primary wellbore to a secondary wellbore, the system comprising: a retractable transition joint (RTJ) comprising: at least two members; wherein a first member is operable to retract into a second member; a tubular extending through the first and second members, the tubular comprising a distal end removably attached to a distal end of the second member; a shifting device, wherein the first member of the RTJ is operable to receive a portion of the shifting device, wherein the first and second members of the RTJ are operable to receive the control line.

Statement 10. The system of the statement 9, further comprising a liner.

Statement 11. The system of the statement 9 or the statement 10, wherein a distal end of the second member comprises a latching mechanism operable to latch to the liner.

Statement 12. The system of any of the statements 9-11, wherein the first and second members are disposed between the liner and the multilateral junction.

Statement 13. The system of any of the statements 9-12, wherein the first member comprises a scoop operable to receive a portion of the multilateral junction.

Statement 14. The system of any of the statements 9-13, wherein a portion of the distal end of the tubular comprises a bull nose that projects outward from the second member.

Statement 15. The system of any of the statements 9-14, wherein the first member is operable to unlock from the second member.

Statement 16. A method for passing a control line from a primary wellbore to a secondary wellbore, the method comprising: disposing a retractable transition joint (RTJ) into the primary wellbore; moving the RTJ from the primary wellbore into the secondary wellbore through a window that is disposed between the primary wellbore and the secondary wellbore; passing the control line through the RTJ; and retracting the RTJ within the secondary wellbore.

Statement 17. The method of the statement 16, further comprising latching the RTJ to a liner.

Statement 18. The method of the statement 16 or the statement 17, further comprising unlocking telescopic members of the RTJ to allow the retracting.

Statement 19. The method of any of the statements 16-18, further comprising receiving with the RTJ a multilateral junction.

Statement 20. The method of any of the statements 16-19, further comprising unlocking a distal end of the RTJ.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A retractable transition joint (RTJ) for passing a control line from a primary wellbore to a secondary wellbore, the RTJ comprising:

at least two members;

wherein a first member is operable to retract into a second member; and a tubular extending through the first and second members, the tubular comprising a distal end removably attached to a distal end of the second member, wherein the first and second members are operable to receive the control line, wherein a proximal end of the first member includes a tapered profile that is operable to protect and guide the control line into the RTJ.

2. The retractable transition joint of claim 1, wherein the proximal end is opposite to the distal end of the second member, the proximal end operable to receive a portion of a shifting device.

3. The retractable transition joint of claim 1, wherein a portion of the first member is disposed and locked to the second member.

4. The retractable transition joint of claim 1, wherein the first member is movably disposed within the second member.

5. The retractable transition joint of claim 1, wherein the distal end of the second member includes a collet and a lock.

6. The retractable transition joint of claim 1, wherein the distal end of the second member includes a lock.

7. The retractable transition joint of claim 1, wherein the distal end comprises a bull nose.

8. The retractable transition joint of claim 1, wherein the distal end of the second member comprises a collet operable to latch to a liner.

9. A system for passing a control line from a primary wellbore to a secondary wellbore, the system comprising:

a retractable transition joint (RTJ) comprising:

at least two members;

wherein a first member is operable to retract into a second member;

a tubular extending through the first and second members, the tubular comprising a distal end removably attached to a distal end of the second member;

a shifting device, wherein the first member of the RTJ is operable to receive a portion of the shifting device, wherein the first and second members of the RTJ are operable to receive the control line, wherein a proximal end of the first member includes a tapered profile that is operable to protect and guide the control line into the RTJ.

10. The system of claim 9, further comprising a liner.

11. The system of claim 10, wherein a distal end of the second member comprises a latching mechanism operable to latch to the liner.

12. The system of claim 10, wherein the first and second members are disposed between the liner and the multilateral junction.

13. The system of claim 9, wherein the first member comprises a scoop operable to receive a portion of the multilateral junction.

14. The system of claim 9, wherein a portion of the distal end of the tubular comprises a bull nose that projects outward from the second member.

15. The system of claim 9, wherein the first member is operable to unlock from the second member.

16. A method for passing a control line from a primary wellbore to a secondary wellbore, the method comprising: disposing a retractable transition joint (RTJ) into the primary wellbore, the RTJ including a first member that is operable to retract into a second member; moving the RTJ from the primary wellbore into the secondary wellbore through a window that is disposed between the primary wellbore and the secondary wellbore; passing the control line through the RTJ; and retracting the RTJ within the secondary wellbore, wherein a proximal end of the first member is operable to protect and guide the control line into the RTJ.

17. The method of claim 16, further comprising latching the RTJ to a liner.

18. The method of claim 16, further comprising unlocking telescopic members of the RTJ to allow the retracting.

19. The method of claim 16, further comprising receiving with the RTJ a multilateral junction.

20. The method of claim 16, further comprising unlocking a distal end of the RTJ.

* * * * *